US005269718A

United States Patent [19]

Reed

[11] Patent Number: 5,269,718

[45] Date of Patent: Dec. 14, 1993

[54] TOY RACING CAR WITH IMPROVED PROPULSION MEANS

[76] Inventor: David A. Reed, 951 E. Fenley #4, Tucson, Ariz. 85706

[21] Appl. No.: 931,964

[22] Filed: Aug. 19, 1992

[51] Int. Cl.[5] ..... A63H 30/04; A63H 17/16; A63H 29/10

[52] U.S. Cl. ..... 446/456; 446/440; 446/176; 446/178

[58] Field of Search ..... 446/454, 456, 431, 440, 446/460, 468, 469, 470, 176, 178, 211, 199

[56] References Cited

U.S. PATENT DOCUMENTS

| | | | |
|---|---|---|---|
| 2,836,253 | 5/1958 | Lovell | 446/454 X |
| 3,683,546 | 8/1972 | Congdon | 446/456 |
| 3,784,174 | 1/1974 | Tarnofsky | 446/454 X |
| 3,785,085 | 1/1974 | Peroni | 446/176 |
| 3,885,346 | 5/1975 | Trattner | 446/176 |
| 3,896,735 | 7/1975 | Fischer | 446/176 X |
| 3,914,898 | 10/1975 | Ferguson | 446/470 |
| 4,267,663 | 5/1981 | Nagahara | 446/440 |
| 4,568,306 | 2/1986 | Martin | 446/456 X |
| 4,781,649 | 11/1988 | Nagano | 446/456 X |
| 4,886,478 | 12/1989 | Jones | 446/176 |

FOREIGN PATENT DOCUMENTS

| | | | |
|---|---|---|---|
| 517888 | 6/1957 | Italy | 446/454 |
| 609962 | 10/1960 | Italy | 446/450 |

*Primary Examiner*—Robert A. Hafer
*Assistant Examiner*—D. Neal Muir
*Attorney, Agent, or Firm*—E. Michael Combs

[57] ABSTRACT

The present invention includes a radio-controlled toy racing car having an elongate, light-weight tubular body constructed of polymeric material. Rotatably mounted on the front end of the body is a front wheel and steering shaft for controlling the directional turning movements of the car. The car is supported at its rear end by a pair of wheels mounted on the respective outer ends of an axle extending laterally from the body, and is driven by an engine pivotally mounted on the body adjacent the rear end thereof. A spoiler is pivotally mounted on the body and behind the engine at a position near the rear end of the body and above the center of the axle to utilize the wind force of the drive engine's propeller to exert a downward and stabilizing force on the rear wheels. Further, a braking element comprising a parachute is housed within the body near the rear end thereof. Control of front wheel movement, engine operation, and parachute deployment are effected remotely from a radio transmitter sending signals to a receiver and separate control elements mounted on the body for the front wheel, engine, and parachute.

16 Claims, 4 Drawing Sheets

TOY RACING CAR WITH IMPROVED PROPULSION MEANS

BACKGROUND OF THE INVENTION

1. Field of the Invention

The field of the invention relates to toy racing cars, and more particularly to radio-controlled toy racing cars.

2. Description of the Prior Art

The recreational sport of racing radio-controlled toy cars has been and continues to be an extremely popular activity. Organized groups regularly engage in competitive racing events in shopping mall parking lots, designated racing strips, and at other indoor and outdoor venues. However, many of the radio-controlled toy racing cars are of complex construction and thus expensive to buy and operate, whether purchased in either assembled or kit form.

A wide variety of radio-controlled toy racing cars have been utilized in the prior art. For example, U.S. Pat. No. 4,457,101 to Matsushiro sets forth a battery powered, radio-controlled toy car having one front and two rear wheels. The car is capable of changing its running movements during "wheelie motion", i.e. with the front wheel off the ground, using a relatively complex arrangement including a differential mechanism, two electromagnetic brake mechanisms, and two independent drive shafts.

U.S. Pat. No. 4,816,795 to Suto illustrates another radio-controlled toy racing car having an electromagnetic directional control device having a cylindrical magnet and a magnetic coil wound on a yoke of magnetic material rotatably mounted within the magnet. The yoke is connected to steering arms which are in turn attached to the car's wheels for controlling their movements.

U.S. Pat. No. 4,882,942 to Hamilton discloses an attachment used with toy racing car radio control transmitters to convert a linear motion transmitter to a rotary transmitter for controlling directional movement of the car.

As such, it may be appreciated that there continues to be a need for a new and improved radio-controlled toy racing car which addresses both the problems of ease of use, portability, cost, and simplicity in construction, and in this respect, the present invention fulfills this need.

SUMMARY OF THE INVENTION

In view of the foregoing disadvantages inherent in the known types of toy racing cars now present in the prior art, the present invention provides a radio-controlled toy racing car having an elongate body supported for movement on three wheels wherein the driving and control elements are positioned in longitudinally spaced and aligned positions along the body . As such, the general purpose of the present invention, which will be described subsequently in greater detail, is to provide a new and improved radio-controlled toy racing car which has all the advantages of the prior art toy racing cars and none of the disadvantages.

To attain this, the present invention includes a radio-controlled toy racing car having an elongate, lightweight tubular body constructed of polymeric material such as polyvinylchloride or PVC. Rotatably mounted on an inclined forward face at the front end of the body is a front wheel and steering shaft for controlling the directional turning movements of the car. Control of the front wheel movements is effected remotely from a radio transmitter sending radio signals to a receiver and a steering servo mounted on the body which is mechanically linked to the steering shaft. At the rear end of the body a pair of wheels are mounted on the outer ends of an axle extending laterally from the body. Pivotally mounted on the body adjacent the rear end thereof is either a gasoline or an electrically powered engine to drive the car. Either drive means is also operated remotely by the body-mounted receiver and either a throttle servo or a battery pack, respectively. A spoiler is pivotally mounted on the body and behind the engine and at a position near the rear end of the body and above the center of the axle to utilize the wind force of the drive engine's propeller to exert a downward and stabilizing force on the rear wheels. Further, braking means for the car comprises a parachute housed and secured in the body adjacent its rear end. The parachute is positioned behind an inclined trap door hinged to the rear end of the body and may be deployed by opening the trap door using a remotely controlled latch pin mounted on the trap door using the same remote transmitter and body-mounted receiver.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the included abstract is to enable the U.S. Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The abstract is neither intended to define the invention of the application, which is measured by the claims, nor is it intended to be limiting as to the scope of the invention in any way.

It is therefore an object of the invention to provide a new and improved radio-controlled toy racing car which has all the advantages of the prior art toy racing cars and none of the disadvantages.

It is another object of the present invention to provide a new and improved radio-controlled toy racing car which may be easily and efficiently manufactured and marketed.

It is a further object of the present invention to provide a new and improved radio-controlled toy racing car which is of durable and reliable construction.

An even further object of the present invention is to provide a new and improved radio-controlled toy racing car which is susceptible of a low cost of manufacture with regard to both materials and labor, and which accordingly is then susceptible of low prices of sale to the consuming public, thereby making such radio-controlled toy racing cars economically available to the buying public through hobby shops, sporting goods stores, large national discount chain stores, as well as appropriate hobby magazines and publications. Further, its modest cost will encourage hobbyists, either expert or novice, to purchase several cars to participate in organized racing events.

Still yet another object of the present invention is to provide a new and improved radio-controlled toy racing car which provides in the apparatuses and methods of the prior art some of the advantages thereof, while simultaneously overcoming some of the disadvantages normally associated therewith.

Still another object of the present invention is to provide a new and improved radio-controlled toy racing car having component elements which are aerodynamically shaped, arranged on the body for proper weight distribution, and constructed of light weight materials to maximize racing, i.e. speed and handling, performance.

Yet another object of the present invention is to provide a new and improved radio-controlled toy racing car which is simple in design and produced form readily available materials to permit it to be sold in either completely assembled or kit form.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
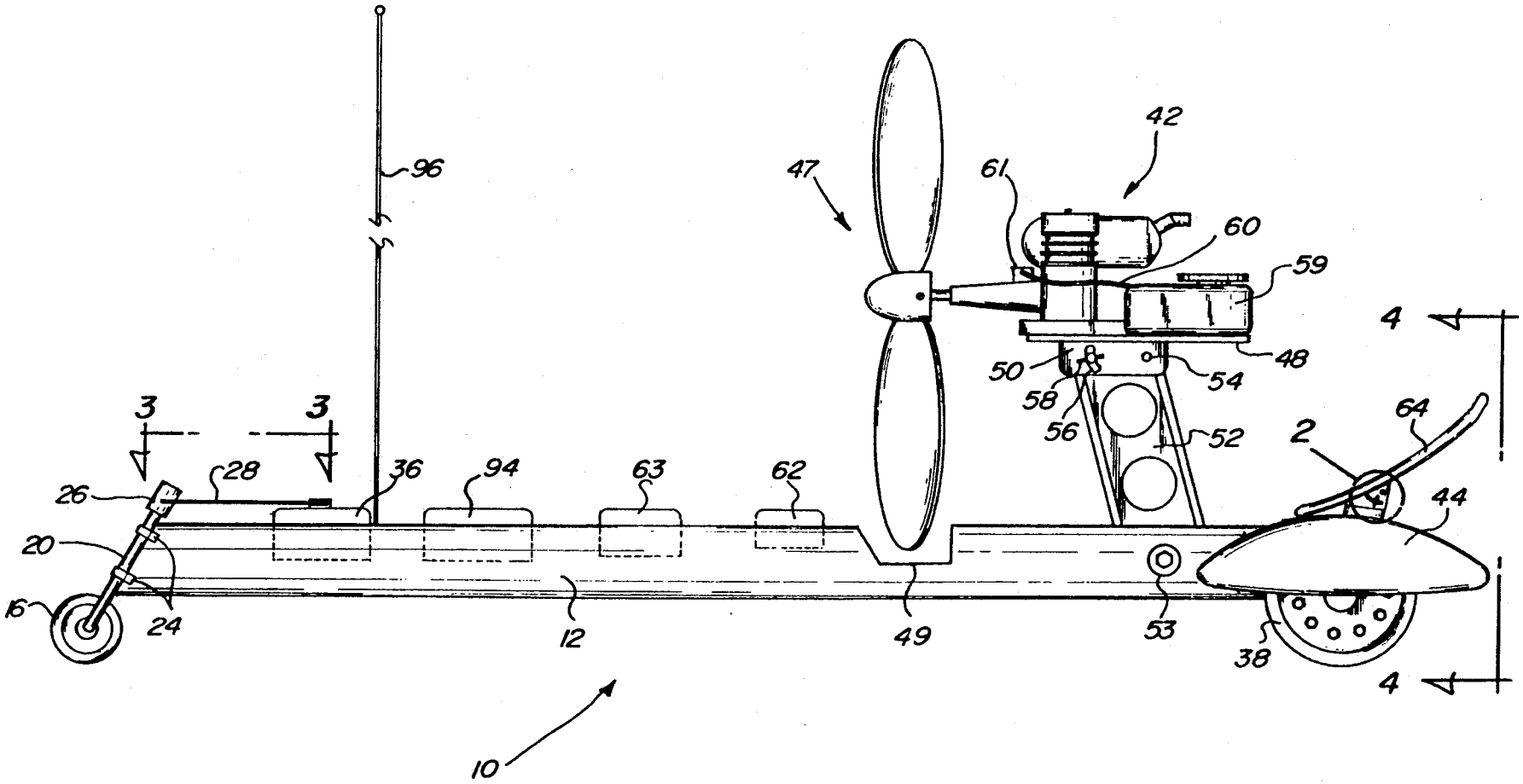
FIG. 1 is a side view of the radio-controlled toy racing car of the present invention.

With reference now to the drawings, and in particular to FIGS. 1-7, a new and improved radio-controlled toy racing car embodying the principles and concepts of the present invention and generally designated by the reference numeral 10 will be described.

Figure 3:
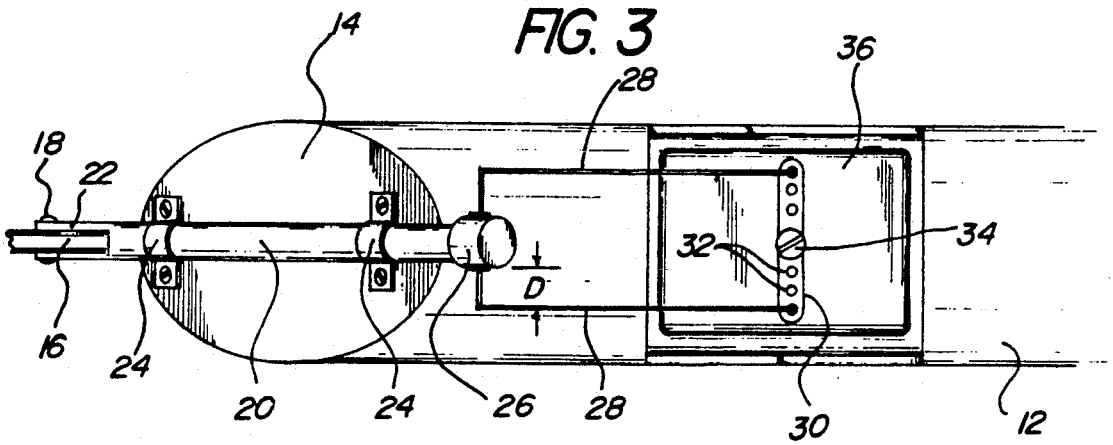
FIG. 3 is a partial plan view of the racing car taken along line 3—3 in FIG. 1.

More specifically, and with particular reference to FIG. 1, a radio-controlled toy racing car 10 of the present invention essentially comprises an elongate, lightweight tubular body 12. Body 12 may be constructed of 1" schedule 40 PVC pipe and is provided with an angled, oval forward end face 14 (FIG. 3). A front wheel 16 is positioned beneath end face 14 and is rotatably mounted on a spindle 18 extending through the bifurcated end 22 of a steering shaft 20. Steering shaft 20 is rotatably fixed on end face 14 by a pair of longitudinally spaced retaining straps 24 (FIG. 3). An end cap 26 is fixed on an opposite end of steering shaft 20. Detachably connected to diametrically opposite sides of end cap 26 are a pair of L-shaped control rods 28. The opposite ends of control rods 28 are detachably connected to a control bar 30 pivotally mounted on a steering servo 36 by a centrally positioned pivot pin 34. Control bar 30 has a plurality of equally spaced control rod attaching holes 32 on each side of pivot pin 34. A plurality of sets of control rods may be provided wherein each set comprises a matched pair of control rods 28, each control rod 28 of each matched pair having a short leg of a length equal to the lateral distance D (FIG. 3) between the attaching hole 32 of its long leg and the connection means (not shown) of the short leg on end cap 26. In this manner, a selected matched pair of control rods 28 may alternatively be connected between end cap 26 and a matched pair of attaching holes 32 on control bar 30 to adjust the turning radius of front wheel 16, and thus car 10.

Figure 4:
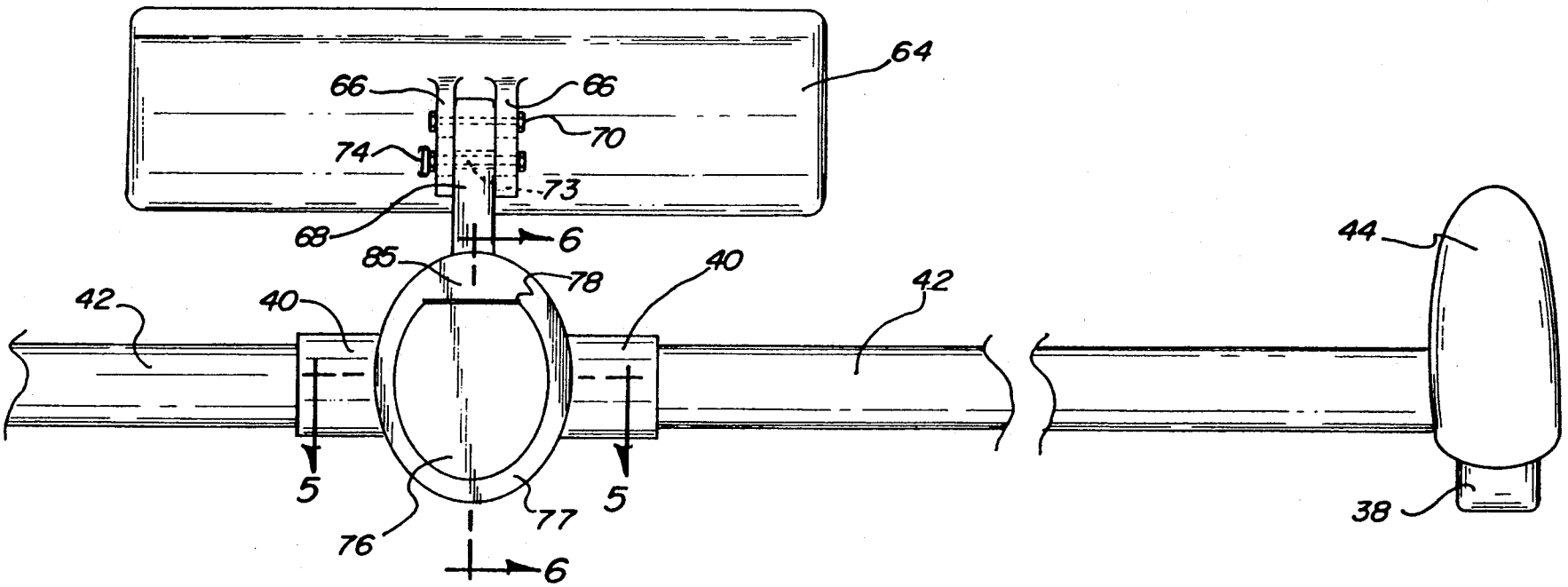
FIG. 4 is a partial end view of the racing car taken along line 4—4 in FIG. 1.
Figure 5:
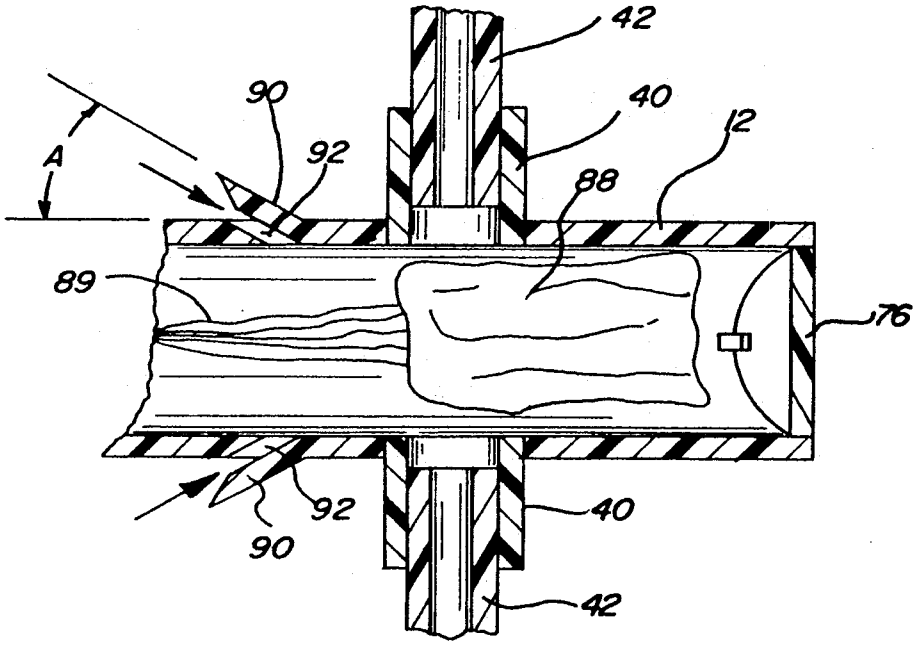
FIG. 5 is a cross-sectional view of a rear end portion of the racing car taken along line 5—5 in FIG. 4.
Figure 6:
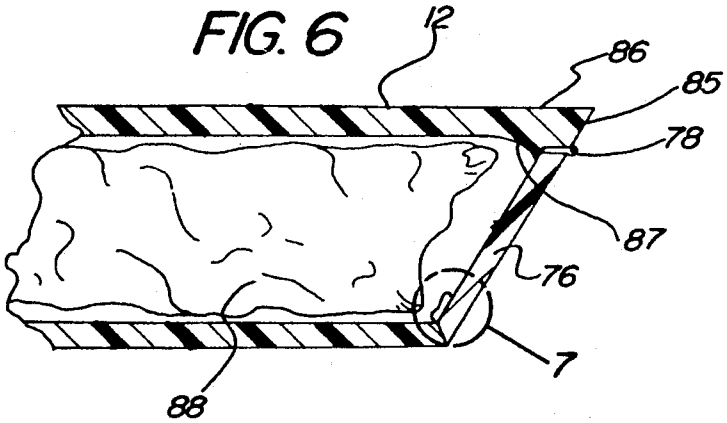
FIG. 6 is a cross-sectional view of a rear end portion of the racing car taken along line 6—6 in FIG. 4.
Figure 7:
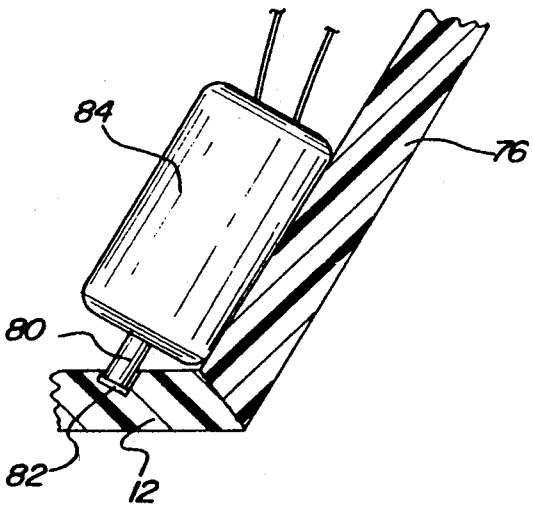
FIG. 7 is a cross-sectional view of those parts of the rear end portion of the racing car lying within circle 7 in FIG. 6.

Referring now to FIGS. 1,4, and 5, a rear wheel 38 is rotatably mounted on the outer end of each of a pair of axles 42. Axles 42 are each pressed into a hub 40 which in turn are each pressed into a hole in body 12. The hub-receiving holes in body 12 are axially aligned on diametrically opposite sides of body 12. Accordingly, each wheel 38 is supported by an axially aligned assembly of a hub 40 and an axle 42 extending laterally from each side of body 12 at its rear end. The upper portions of wheels 38 are each covered by aerodynamically shaped pods 44 to reduce drag. Hubs 40 and axles 42 may also be constructed of PVC tubing. Exemplary dimensions of racer 10 are a length of 36", a height of 11", and a width across rear wheels 38 of 24".

Mounted adjacent to the rear end of body 12 is an engine 46 with a propeller 47 for driving car 10. Engine 46 may be a gasoline model airplane engine having a displacement of 0.020–0.028 cubic centimeters. Propeller 47 is preferably 8" in diameter; however, to achieve top speed, a 9" diameter propeller is required. Using a 9" diameter propeller, speeds of over 50 mph have been achieved. A clearance slot 49 is provided in body 12 to accommodate a 9" propeller 47. Engine 46 is mounted on a platform 48 having a support flange 50 extending integrally and downwardly from the underside thereof. Platform 48 is pivotally mounted on one end of a support beam 52 which extends angularly upwardly and forwardly from body 12. The opposite end of beam 52 is secured to body 12 by a bolt 53. The pivotal mounting of platform 48 on one end of support beam 52 is effected by a pivot pin 54 which extends through support flange 50 and support beam 52. Platform 48 should be positioned as far to the rear as possible to assure proper weight distribution and thereby achieve effective cornering of the car 10. At the same time, platform 48 should be mounted as low as possible to reduce drag while allowing enough clearance for the use of the 9" propeller 47 (by means of the clearance slot 49) to achieve maximum speed. Support flange 50 has an arcuate angle adjusting slot 56 centered about pivot pin 54. Extending through slot 56 and a hole (not shown) in support beam 52 is an angle adjusting bolt 58. The center of the noted hole in beam 52 lies on the arcuate center line of slot 56 and is located at the center of slot 56 when platform 48 is in the horizontal position as shown in FIG. 1. The hole has a diameter just large enough to receive the shank of bolt 58 to thereby maintain it in a fixed position on beam 52. Slot 56 has an arcuate length of approximately one-half to three-quarters of an inch. With this arrangement, the mounting angle of platform 48 on beam 52 can be adjusted by loosening bolt 58, rotating platform 48 about pivot pin 54 to a selected angular position, and then retightening bolt 58. Adjustment of the angle of platform 48 and propeller 47 permits fine tuning of vehicle drag and the driving force output of propeller 47. A fuel tank 59 is mounted on platform 48, and a fuel line 60 connects tank 59 to carburetor 61. A fuel flow control valve (not shown) is installed in line 60. The fuel flow rate is remotely controlled by throttle servo 62 which actuates the valve in line 60. Mounting of the fuel tank 59 on platform 48 insures the delivery of all of the fuel in the tank 59 to carburetor 61. More specifically, if the fuel tank 59 was mounted on body 12, the suction of engine 46 would be insufficient to pull fuel up to carburetor 61 when the tank is approximately half empty. A four ounce capacity fuel tank 59 which allows 20–30 minutes of racing is preferred. Alternatively, car 10 may be driven by a remotely-controlled electric motor (not shown) powered by a battery pack 63 mounted on body 12.

Figure 2:
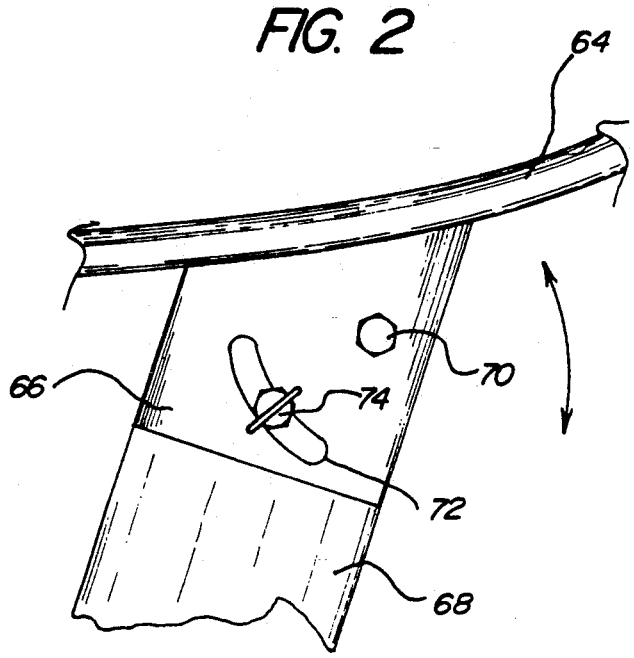
FIG. 2 is a side view of a portion of the racing car lying within circle 2 in FIG. 1.

Mounted behind or downstream from platform 48 at a position substantially at the rear end of body 12 and centrally between and directly above hubs 40 and axles 42 is a spoiler 64 (FIGS. 1,2 and 4). Spoiler 64 uses the wind force thrust against it by propeller 47 to exert a downward and stabilizing force on rear wheels 38. Extending integrally and downwardly from the underside of spoiler 64 are a pair of parallel support flanges 66. Spoiler 64 is pivotally mounted on one end of a support post 68 extending angularly upwardly and backwardly from body 12. The opposite end of support post 68 is secured to body 12 by a bolt (not shown). The pivotal mounting of spoiler 64 on one end of support post 68 is effected by means of a structural arrangement which is substantially identical to the mounting arrangement of platform 48, i.e. using a pivot pin 70 which extends through support flanges 66 and support post 68. Support flanges 66 each have an arcuate angle adjusting slot 72 centered about pivot pin 70, and the slots 72 are laterally aligned with each other. Extending through slots 72 and a hole 73. (FIG. 4) in support post 68 is an angle adjusting bolt 74. The center of hole 73 lies on the arcuate center line of slots 72, and is located at the center of slots 72 when support flanges 66 are aligned with support post 68 as shown in FIG. 2. Hole 73 has a diameter just large enough to receive the shank of bolt 74 to thereby maintain it in a fixed position on support post 68. With this arrangement, the angle of spoiler 64 and thus the downward stabilizing force on rear wheels 38 can be adjusted by loosening bolt 74, rotating spoiler 64 about pivot pin 70 to a selected angular position, and then retightening bolt 74.

In summary, the angular adjustment of platform 48 and spoiler 64 enables the racing car owner to provide his car 10 with an optimum balance of minimum drag, maximum driving force, and maximum rear stabilizing force which therefore results in top racing speeds and superior handling characteristics.

With reference to FIGS. 4–7, a braking assembly for car 10 will now be described. The rear end of body 12 is provided with an obtusely angled, oval end wall comprising a substantially oval trap door 76 surrounded by a substantially oval annular ring 77. Door 76 is rotatably connected to ring 77 by a hinge 78 extending along their chordal interface. Door 76 is locked in its closed position (FIGS. 6 and 7) by a retractable latch pin 80 inserted into a complementary notch 82 in the wall of body 12. Latch pin 80 is retractable from notch 82 by a solenoid 84 which is mounted centrally on a lower end of door 76. Ring 77 has an enlarged upper portion 85 (FIGS. 4 and 5) adjacent to and extending along hinge 78. Portion 85 has a thickened section 86 (FIG. 6) having a concave inner surface 87 which smoothly merges with an inner wall of body 12 at one end thereof and ends at a point adjacent hinge 78. Thickened wall section 86 is also laterally coextensive with hinge 78. Positioned inside body 12 adjacent door 76 is a parachute canopy 88 which has the ends of its cords 89 secured to the inside of the body 12. The smooth and concave contour of surface 87 directs canopy 88 downwardly and away from the hinge area of door 76 and thus assures tangle-free ejection thereof from body 12. Positioned behind or upstream of parachute canopy 88 are a pair of air vents positioned on diametrically opposite sides of body 12. Each air vent is composed of an arcuate cover 90 overlying an arcuate slot 92 of the same arcuate length. The air vents form an acute angle A (FIG. 5) with the portion of body 12 upstream of the vents.

As further shown in FIG. 1, a radio signal receiver 94 having an antenna 96 is mounted on body 12 behind or downstream of steering servo 36. Receiver 94 is connected to steering servo 36, throttle 62, as well as solenoid 84. In use, radio control of steering direction, speed, and braking of car 10 is effected by a remote radio transmitter (not shown) having the appropriate control actuators for each function which are initiated by an operator. To control steering direction, a steering signal is accepted by receiver 94 from the remote transmitter. Receiver 94 then actuates steering servo 36 which in turn rotates control bar 30 and wheel 16 in the desired direction. Control of car speed is similarly effected through receiver 94 which actuates throttle servo 62 which in turn operates the fuel flow control valve (not shown) in fuel line 60 to control the fuel flow rate to the engine. Finally, car braking is also effected through receiver 94 which actuates solenoid 84 which in turn retracts latch pin 80 from notch 82 in body 12. The force generated by the air flowing into body 12 through air vents 90,92 acts on the unlocked door 76 causing it to swing open on hinge 78. Further, the force also acts on the parachute canopy 88 to push it and portions of the cords 89 out of body 12 to fully expand canopy 88 which effects braking of the speeding car 10.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A radio-controlled toy racing car comprising:

an elongate, longitudinally extending body having a forward end and an opposed rear end;

a first wheel rotatably mounted on said forward end of said body;

an axle mounted on said rear end of said body and extending laterally outwardly therefrom;

a second wheel rotatably mounted on one end of said axle;

a third wheel rotatably mounted on an opposite end of said axle;

drive means positioned adjacent said rear end of said body for propelling said car;

first pivotal mounting means for adjustably securing said drive means in a selected angular position on said body, wherein said first pivotal mounting means includes a support beam fixed at one end thereof to said body and extending upwardly therefrom, a platform mounted on an upper, opposite end of said support beam, said drive means being mounted on said platform in a position above said body, a first support flange extending integrally and downwardly from an underside of said platform, a first pivot pin extending through said support beam and said first support flange for pivotally mounting said platform on said upper, opposite end of said support beam, a first arcuate angle adjusting slot in said first support flange, said first adjusting slot being centered about said first pivot pin, a first hole in said support beam, said first hole being aligned with said first adjusting slot, and a first angle adjusting bolt extending through said first adjusting slot and said first hole for adjustably securing said platform in a desired angular position on said support beam;

stabilizing means;

second pivotal mounting means for adjustably securing said stabilizing means in a selected angular position on said body at a position downstream of said drive means and directly above said axle; and braking means mounted within said body at said rear end thereof.

2. The radio-controlled toy racing car of claim 1, wherein said body and said axle are tubular and constructed of polymeric material.

3. The radio-controlled toy racing car of claim 2, wherein said polymeric material is PVC.

4. The radio-controlled toy racing car of claim 1, further comprising an aerodynamically shaped pod mounted on each of said opposite ends of said axle for covering an upper portion of each of said second and third wheel.

5. The radio-controlled toy racing car of claim 1, further comprising first control means mounted on said body and connected to said first wheel for regulating turning movements thereof;

remotely-controlled means mounted on said body for selectively operating said first control means; and first connecting means for joining said first control means to said to said remotely-controlled means.

6. The radio-controlled toy racing car of claim 5, wherein said forward end of said body has an end face;

wherein said first control means includes:

a steering shaft having a pair of opposed ends, wherein one of said shaft ends is bifurcated;

a spindle mounted on said bifurcated end of said steering shaft, said first wheel being mounted on said spindle;

a pair of retaining straps longitudinally spaced along said steering shaft for rotatably fixing said steering shaft against said end face;

an end cap mounted on said other end of said steering shaft;

a pair of L-shaped control rods each comprising a short and a long leg, said short legs of said L-shaped control rods being respectively detachably connected to diametrically opposed sides of said end cap;

a control bar having at a plurality of pairs of attaching holes, wherein said attaching holes of each pair are respectively positioned on opposite sides of, and equally spaced from, the center of said control bar to define a separating distance between said attaching holes of each pair, wherein said separating distance of each pair of attaching holes is different, said long legs of said L-shaped control rods being respectively detachably connected to a selected one of said plurality of pairs of attaching holes;

a steering servo mounted on said body for pivoting said control bar about its center for regulating the directional turning movements of said first wheel; and means for pivotally connecting said control bar at its center to said steering servo;

wherein said first connecting means joins said steering servo to said remotely-controlled means.

7. The radio-controlled toy racing car of claim 6, wherein said end face is inclined and oval.

8. The radio-controlled toy racing car of claim 1, wherein said drive means includes an engine and a propeller connected to and driven by said engine.

9. The radio-controlled toy racing car of claim 8, further comprising a propeller clearance slot in said body, said clearance slot being positioned directly below and in vertical alignment with said propeller to receive an outer peripheral portion of said propeller.

10. The remotely-controlled toy racing car of claim 1, further comprising second control means mounted on said body and said platform and connected to said engine for regulating speed of the car;

remotely-controlled means mounted on said body for selectively operating said second control means; and second connecting means for joining said second control means to said remotely-controlled means.

11. The radio-controlled toy racing car of claim 10, wherein said second control means includes:

a fuel tank mounted on said platform;

a carburetor mounted on said engine;

a fuel line connecting said fuel tank and said carburetor;

a flow control valve positioned in said fuel line;

a throttle servo mounted on said body for regulating the flow rate of fuel to said carburetor and thus said speed of the car; and means connecting said flow control valve to said throttle servo;

wherein said second connecting means joins said throttle servo to said to said remotely-controlled means.

12. The radio-controlled toy racing car of claim 1, wherein said stabilizing means is a spoiler.

13. The radio-controlled toy racing car of claim 12, wherein said second pivotal mounting means includes:

a support post fixed at one end thereof to said body, and extending upwardly therefrom;

a pair of parallel second support flanges extending integrally and downwardly from an underside of said spoiler;

wherein an upper, opposite end of said support post is positioned between said second support flanges;

a second pivot pin extending through said support post and said second support flanges for pivotally mounting said spoiler on said upper, opposite end of said support post;

a second arcuate angle adjusting slot in each of said second support flanges, wherein said second arcuate angle slots are aligned with each other and centered about said second pivot pin; and a second angle adjusting bolt extending through said second arcuate angle adjusting slots and a second hole in said support post for adjustably securing said spoiler in a desired angular position on said support post.

14. The radio-controlled toy racing car of claim 1, wherein said braking means comprises a parachute housed in and secured to said body at a position adjacent said rear end of said body.

15. The radio-controlled toy racing car of claim 14, further comprising third control means arranged on said body for deploying said parachute;

remotely-controlled means mounted on said body for selectively operating said third control means; and third connecting means for joining said third control means to said remotely-controlled means.

16. The radio-controlled toy racing car of claim 15, wherein said rear end of said body has an inclined and oval end wall which includes:

a substantially oval annular ring;

a substantially oval trap door positioned within said annular ring; and a hinge rotatably connecting said annular ring and said trap door;

wherein said annular ring has an enlarged portion having a thickened section with a smoothly concave inner surface which merges with an inner wall of said body at one end of said section and extends to a point adjacent said hinge at an opposite end of said section;

wherein said third control means includes:

a pair of diametrically opposed air vents formed in said body at a position upstream of said parachute and said trap door;

a solenoid mounted on an inside surface of said trap door at a position opposite to said hinge;

a movable latch pin connected to said solenoid; and a notch formed in an inner wall of said body, said notch being aligned with and dimensioned to receive said latch pin therein and secure said trap door in a closed position to maintain the parachute within said body until braking is required;

wherein said third connecting means joins said solenoid to said remotely-controlled means for operating said solenoid and retracting said latch pin from said notch to enable air flowing through said vents and into said body to open said trap door and force said parachute out of said body to brake said car.

* * * * *